US006719211B2

(12) United States Patent
Takeuchi et al.

(10) Patent No.: US 6,719,211 B2
(45) Date of Patent: Apr. 13, 2004

(54) DROPLET EJECTING APPARATUS

(75) Inventors: Yukihisa Takeuchi, Nagoya (JP); Koji Kimura, Nagoya (JP); Kazuhiro Yamamoto, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 193 days.

(21) Appl. No.: 10/057,749

(22) Filed: Oct. 25, 2001

(65) Prior Publication Data

US 2002/0096577 A1 Jul. 25, 2002

(30) Foreign Application Priority Data

Nov. 6, 2000 (JP) ..... 2000-337977

(51) Int. Cl.[7] ..... B05B 3/04
(52) U.S. Cl. ..... 239/102.2; 347/14; 259/69
(58) Field of Search ..... 239/101, 102.1, 239/102.2, 450, 562, 563, 565, 68, 69, 74, 75; 347/14, 19

(56) References Cited

U.S. PATENT DOCUMENTS 6,200,013 B1 3/2001 Takeuchi et al.

FOREIGN PATENT DOCUMENTS

JP 8-201265 8/1996
JP 11-301626 11/1999
JP 2001-270111 10/2001

OTHER PUBLICATIONS

U.S. patent application Ser. No. 09/297,655, Takeuchi et al., filed May 4, 1999.
U.S. patent application Ser. No. 09/387,012, Takeuchi et al., filed Aug. 31, 1999.
U.S. patent application Ser. No. 09/429,140, Hirota et al., filed Oct. 28, 1999.
U.S. patent application Ser. No. 10/071,019, Takeuchi et al., filed Feb. 28, 2002.

*Primary Examiner*—Michael Mar
*Assistant Examiner*—Thach H. Bui
(74) *Attorney, Agent, or Firm*—Burr & Brown

(57) ABSTRACT

A droplet ejecting apparatus includes: a droplet quantity evaluation apparatus, wherein the mass of a droplet ejected onto an article is measured, and a measurement signal is generated based on the measurement result; a feedback control apparatus, wherein the measurement signal is compared with a respective reference value and then a control signal is generated based on the result of the comparison; and droplet ejecting apparatus for adjusting the amount of ejection for the droplet on the basis of the control signal. In the droplet apparatus, the amount of droplets ejected from the droplet ejecting apparatus can be accurately determined in real time, and the variation in the amount of ejected droplets, the presence thereof and the deviation of the arrival position thereof can also be determined.

28 Claims, 4 Drawing Sheets

DROPLET EJECTING APPARATUS

BACKGROUND OF THE INVENTION

1. Field of the Invention

The present invention relates to a droplet ejecting apparatus for stably and accurately ejecting micro droplets. More specifically, the present invention relates to a droplet ejecting apparatus, which can be promptly operated at an arbitrary moment when said droplet ejecting apparatus is operated, in which case the amount of droplets actually ejected is quantitatively measured, and control is performed, based on the information obtained by the quantitative measurement.

2. Description of the Related Art

Micro droplet ejecting means play an essential role in the fields of biotechnology as well as in the fields of manufacturing chemicals, foods, etc, since the stability regarding the amount of ejected droplets and the accuracy regarding the position thereof directly relates to the quality and the producibility of the products manufactured using the droplet ejecting apparatus.

Generally, the amount of droplets is normally determined only by the droplet ejecting means itself. However, there is no means for determining the final positions at which the ejected droplets arrive. At present, the products produced from ejected droplets are inspected in an initial test in terms of the quality and/or byproducts produced from the ejected droplets by using certain detection means. On the basis of the results obtained in these investigations, the droplet ejecting means is controlled. As a result, a relatively long inspection period is necessary in periodical inspections of the ejected goods or articles, and therefore there is a problem in that the productivity is reduced. If the amount of a droplet can be evaluated in real time without delay for each ejection, the inspection can be frequently carried out without any reduction in the productivity, so that in an early stage either a bad condition can be ascertained or variations in quality can be suppressed, thereby allowing a high quality to be maintained. Such requirements have been previously described.

For instance, a method for uniformly mixing materials and a mixing apparatus have been proposed in Japanese Unexamined Patent Application Publication No. 11-262644. In the specification, it is pointed out that a treatment of mixing micro materials and reacting them with each other is required for research in the field of biotechnology, and in order to satisfy these requirements, two or more piezoelectric control type droplet ejecting means are employed. By colliding micro droplets ejected from different droplet ejecting means with each other, these droplets can be uniformly mixed, thereby enabling different materials to be uniformly reacted with each other, thus allowing uniform reaction products to be obtained.

In such a method for uniformly mixing materials as well as in such a mixing apparatus, the rate of non-collision is determined by collecting uncollided droplets, thereby allowing the collision rate to be increased by correcting the ejection direction of the materials on the basis of the thus determined rate of non-collision via a feedback system.

Moreover, the origin of the instability in the ejection, for instance, the deflection of a droplet flight direction, the variation in both the purity and the reaction of the droplets, the variation in the reaction speed due to variations in temperature and/or variations in both the viscosity and specific gravity of the liquid in a fluid channel, must be investigated in advance, and such instability should preferably be suppressed, based on the results obtained from the investigation.

In these methods, the state of an apparatus was controlled by determining the conditions of operation indirectly relating to the ejection of droplets.

Furthermore, for instance, in Japanese Unexamined Patent Application Publication No. 8-201265, a viscosity measuring apparatus and a method for determining fluid characteristics have been proposed. In this specification, it is emphasized that it is important to measure the viscosity of a fluid in order to ensure the quality of products and/or to control the process for manufacturing the products, where the products are in the form of a fluid, e.g., a chemical, food, lubricant, car wax or the like, and for this reason the viscosity of the fluid is determined, based on the change in the specific electrical constant of an oscillating element made of a piezoelectric material, where the oscillating element is oscillated in the fluid and is subjected to a mechanical resistance resulting from the viscosity of the fluid.

When an anomaly is found in the specific electrical constant of the piezoelectric element, the ejection of droplets is set to cease and then a recovery treatment is performed.

In this method, there is an advantage in that the piezoelectric element can be used not only as an actuator but also as a sensor. However, the piezoelectric element is used exclusively to monitor the characteristics, such as the viscosity, of the fluid stored in a cavity or the like before the ejection, and not to monitor the characteristics of the droplets after ejection.

Moreover, in order to determine the amount of liquid ejected, an electronic force balance is conventionally used to measure the accumulated mass of ejected droplets within the measurement range of the balance, and the mass of one droplet is determined by dividing the accumulated mass by the number of droplets. This method is also unsuitable for controlling the stability in the amount of ejection for a droplet.

Moreover, the present applicant has proposed a micropipette and a separate injecting apparatus in Japanese Patent Application No. 11-301626. In the specification, it is emphasized that, in the production of a DNA chip for analyzing gene structure, it is important to suppress variations in the volume and the shape of individual micro droplets and to preserve the distance between the micro spots at a fixed value. It is described that the micropipette comprises both a main body including a sample supplying opening, a cavity for storing the sample and a sample discharging opening, and a piezoelectric element mounted on the outer surface of the main body at the position corresponding to the cavity, and it is also described that a certain amount of the sample in the cavity can be ejected from the sample ejecting opening with the aid of a change in volume of the cavity by activating the piezoelectric element, thereby enabling micro spots such as DNA chips to be formed very accurately and rapidly.

In this proposal, the cavity is filled in advance with a substitution solution, such as buffer solution or physiological saline solution, and then a sample is supplied into the cavity from the sample supplying opening, by substituting the substitution solution therewith in a laminar flow. After that, the piezoelectric element is activated. In this case, the completion of the substitution in the cavity using the laminar flow is preferably determined not by the volume and moving speed of the sample, but by the change in fluid characteristics in the cavity, in which case the piezoelectric element is activated by applying a voltage thereto and the change in the specific electrical constant in the oscillation of the piezoelectric element is sensed.

In order to more accurately determine the completion of the laminar flow substitution, it is desirable that the change in the characteristics, not of the liquid in the cavity, but of the droplets actually ejected therefrom be measured, if possible. From this viewpoint, the present applicant tried to further modify the droplet ejecting apparatus, and made certain discoveries to reach the present invention, after many investigations.

As described above, it is necessary to maintain the stability in the amount of droplets ejected from a micro droplet ejecting means and the accuracy in sensing the arrival position of the droplets, e.g., in the formation of DNA chips which are necessary for the treatment of mixing and reaction and for analyzing gene structure in biotechnology, or in the formation of micro spots which are necessary for producing protein chips which are used to analyze proteins and the interactions of proteins on the basis of the information, or in the synthesis of liquids in the process of manufacturing chemicals, foods, oil products, etc. In this case, it is desired that the ejection of micro droplets is carried out, not by using a method for analyzing the indirect information resulting from the ejection, but by using a method for directly measuring in real time the ejected droplets themselves.

SUMMARY OF THE INVENTION

Accordingly, it is an object of the present invention to provide a droplet ejecting apparatus which permits secure sensing of variations in the amount of each droplet ejected, the occurrence of ejection, and the deviation of the arrival position to which the droplet is ejected by accurately determining in real time the amount of droplets actually ejected from the micro droplet ejecting means.

It is another object of the present invention to provide a droplet ejecting apparatus which permits control of the amount of droplets ejected from droplet ejecting means and the arrival position of the ejected droplets, by feeding back information on the amount of the droplets to the droplet ejecting means, so that the mixture of the droplets can be homogenized.

It is another object of the present invention to provide a droplet ejecting apparatus which permits possible problems in the droplet ejecting means to be detected at an early stage and the droplets to be stably ejected in a predetermined amount based on the results obtained regarding the arrival position of the ejected droplets.

It is another object of the present invention to provide a droplet ejecting apparatus, which can provide products having high productivity, high quality and good reliability in the field of biotechnology, as well as in the fields of manufacturing chemicals, foods, oil products, etc.

The applicants investigated the method for detecting the failure of droplet ejection, and the method for quantitatively evaluating the droplet, and chose the measurement of the mass of the droplet as a quantitative measuring method, since the results obtained by the method were not influenced by the change in volume of a droplet ejected due to the change in the characteristics of the droplet, e.g., the viscosity, nor by the intentionally changed composition of the droplet. In the method, using both the droplet ejecting means to which an electrical signal can be supplied and the droplet quantity evaluation means, which allows the mass of a micro droplet to be measured and the measurement result to be supplied as an electrical signal, the state of ejection can be ascertained by measuring the mass of a droplet ejected during the operation of the droplet ejecting apparatus. By feeding back the information thus obtained to the droplet ejecting means, the ejection of the droplets can be controlled, so that a predetermined amount of the droplets can be securely ejected to a predetermined position. Hence, the observation of the amount of the ejected droplets and the arrival position thereof is feasible with the droplet ejecting apparatus itself, so that it is possible to automatically correct a possible ejection failure, for instance, an undesirable change in the amount of ejected droplets.

In accordance with the present invention, the following droplet ejecting apparatus is provided in order to attain the above objects.

A droplet ejecting apparatus for ejecting micro droplets comprises at least one droplet quantity evaluation means, wherein the mass of a droplet ejected onto an article is measured, and a measurement signal is generated based on the measurement result; feedback control means, wherein the measurement signal is compared with a respective reference value and then a control signal is generated based on the result of the comparison; and at least one droplet ejecting means for adjusting the amount of ejection for the droplet on the basis of the control signal.

In accordance with the present invention, it is preferable that the droplet ejecting means comprises a micropipette including a cavity for storing a liquid, and a piezoelectric element for changing the volume of the cavity.

Moreover, it is preferable that the droplet quantity evaluation means comprises a measuring member for measuring the change in resonance frequency as a result of receiving the droplet and for supplying the measurement result as an electrical signal, a processing member for determining the mass of the droplet by executing a predetermined calculation on the basis of the supplied electrical signal and for supplying the measurement signal, wherein the measuring member comprises at least a resonance member for providing a change in the resonance frequency in response to the mass of the droplet received by the measuring member, and a frequency measuring member for measuring the change in the resonance frequency, and wherein the resonance member comprises a substrate, a diaphragm for receiving the ejected droplet, a sensing plate including the piezoelectric element for sensing the resonance frequency in the resonance member and a connection plate for connecting the diaphragm and the substrate.

In the droplet ejecting apparatus according to the invention, it is preferable that the mass of the ejected droplet received by one surface or both surfaces of said diaphragm is measured. Moreover, it is preferable that the droplet quantity evaluation means and/or the droplet ejecting means is moved in such a manner that the droplet quantity evaluation means can receive the droplets, and then the mass of said droplet is measured.

In accordance with the present invention, moreover, it is preferable that the droplet quantity evaluation means evaluates the resonance frequencies in the resonance member before and after the droplet is received, and determines the mass of the droplet ejected from the droplet ejecting means on the basis of the evaluated change in the resonance frequency.

It is preferable that the resonance frequency corresponds to the resonance frequency in the oscillation mode consisting mainly of the ν mode oscillation, where the diaphragm linearly reciprocates in the direction parallel to the plane of said diaphragm and perpendicular to the vertical axis vertically passing through a joined plane of the connection plate and the substrate.

In the droplet ejecting apparatus according to the invention, it is preferable that for the maximum size b of the diaphragm in the direction of the vertical axis perpendicularly passing through the joined plane of the connection plate and the substrate and for the maximum size a of the diaphragm in the direction parallel to the flat plane and perpendicular to the vertical axis, the ratio of the sizes satisfies the following relation:

$$0.7<a/b<5.$$

Moreover, it is preferable that for the thickness t (cm) of the diaphragm, the density $d_c$ (g/cm$^3$) of the diaphragm, the volume V (cm$^3$) of a droplet and the density $d_r$ (g/cm$^3$) of the droplet, and the area S (cm$^2$) of the diaphragm are set within a range at which the following relation is satisfied:

$$2.5\times10^{-5}+(1.5\times V)^{2/3}\times\pi^{1/3}<S<V\times d_r\times10^6/(t\times d_c).$$

In the case where the resonance frequency used for measurement is the same as a resonance frequency in the oscillation mode consisting mainly of the ν mode oscillation, it is preferable that the droplet quantity evaluation means and/or the droplet ejecting means is moved in such a manner that the droplet quantity evaluation means receives the droplet in the main oscillation direction of the diaphragm.

Except for the oscillation mode consisting mainly of the ν mode oscillation, it is preferable that the resonance frequency is the same as a resonance frequency in the oscillation mode of the rotation-around-axis oscillation where the diaphragm reciprocates in a rotary oscillation around a vertical axis passing through the joined plane of the connection plate and the substrate. Moreover, it also is preferable that the resonance frequency is the same as a resonance frequency in the oscillation mode of the rotation-in-plane oscillation where the diaphragm reciprocates in a rotary oscillation in a plane containing the diaphragm in such a manner that the center of rotation is situated at least within the diaphragm.

In accordance with the present invention, it is preferable that the direction of ejection in the droplet ejecting means is controlled on the basis of the difference in the sensitivity in the plane of the diaphragm in accordance with the distance from the center of rotation in the diaphragm.

Moreover, it is preferable that the droplet quantity evaluation means has a measurable range of mass greater than the mass of a droplet ejected, and wherein the mass of droplets are can be determined by repeatedly measuring the mass of each drop with the same droplet quantity evaluation means.

In accordance with the present invention, it is preferable that the droplet quantity evaluation can be promptly operated at an arbitrary moment when the droplet ejecting apparatus is operated.

The present invention demonstrates a droplet ejecting apparatus comprises one or more droplet ejecting means to which an electrical signal can be supplied; one or more means for evaluating the quantity of droplet, said means performing the measurement of a micro droplet, and from said means an output being electrically supplied; and a feedback control means to which the electrical signals can be supplied and output, and in said control means various calculations being performed, based on the measurement results regarding the change in the mass of a droplet.

In the present invention, droplets are received by the droplet quantity evaluation, either while moving the droplet ejecting means, or while moving the droplet quantity evaluation on the flight trajectories of the droplets ejected from the droplet ejecting means. Under such a condition, the mass of the ejected droplet is continuously monitored and the monitored results are transferred to the droplet ejecting means, thereby enabling a predetermined amount of droplets to be securely ejected to a predetermined position.

In the present invention, the control of the droplet ejecting means is carried out, not by monitoring the property of droplets before ejection and/or determining the conditions of products indirectly relating to the ejection of droplets, but by measuring the mass of the ejected droplets in real time during the operation period of the droplet ejecting apparatus. With this control, the quantity of each droplet can be evaluated more accurately and a possible failure of ejection can be suppressed, thereby enabling both the quality of the manufactured products and the productivity to be enhanced. The droplet ejecting apparatus according to the invention can be used as a calibration system before or after the operation thereof. However, it is preferable that the apparatus is used to measure in real time the quantity of droplet and to securely avoid a possible ejection failure.

Moreover, the range of mass measurable with the droplet ejecting means in the droplet ejecting apparatus can be set to be greater than the mass of a droplet to be measured. With this structural arrangement, the droplet quantity evaluation means can receive the droplets repeatedly ejected from the droplet ejecting means, and can continuously measure the mass of droplets received or deposited thereon. The mass of each droplet can be determined by the differentiation of the measured results for the ejected droplets.

DETAILED DESCRIPTION OF THE INVENTION

Figure 1:
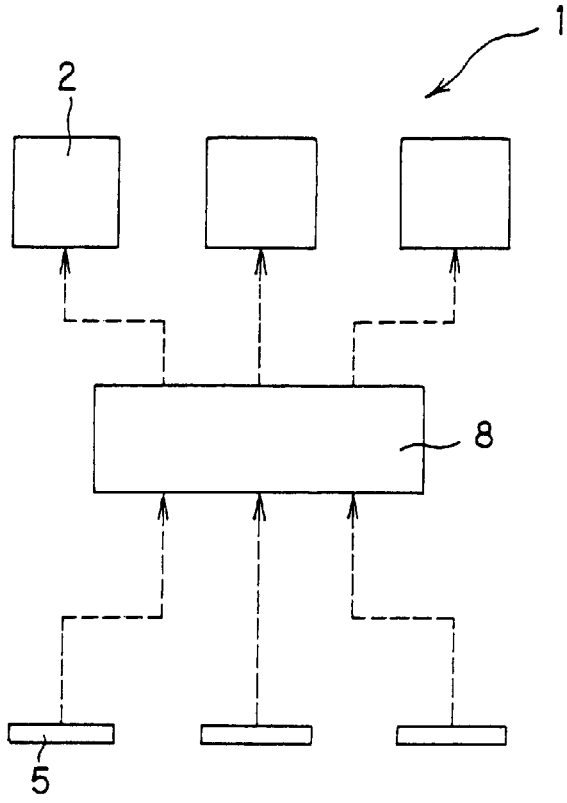
FIG. 1 is a block diagram of an embodiment of a droplet ejecting apparatus according to the invention.

Referring now to the drawings, various embodiments of the droplet ejecting apparatus according to the present invention will be described.

FIG. 1 shows a block diagram of a droplet ejecting apparatus 1, which is equipped with three droplet ejecting means 2, three droplet quantity evaluation means 5, and a feedback control means 8. All of the elements are equipped with means for receiving and transmitting electrical signals of information. As an electrical signal, either an analog or digital voltage signal or an analog or digital current signal can be used, and the means for receiving and transmitting electrical signals of information are designed in accordance with the type of electrical signals. A standard component, for instance, RS 232C, GP-IB, or the like can be employed. The signal transmitting channels between the elements can be realized by wireless or wired components. Each of the above elements includes an input unit, an output unit, and a signal conversion unit for matching the signals between the elements. Moreover, the above-mentioned information is referred to as the characteristic value of the droplet, for instance the mass of the droplet, or control data processed therefrom.

The function of the droplet ejecting apparatus 1 will be described in the case of stabilizing the ejection of the droplets on the basis of the measured mass thereof.

The droplets are ejected from the droplet ejecting means 2, which has been adjusted in advance. The adjustment can be carried out by using either the droplet ejecting apparatus 1 itself or another appropriate means. The droplet quantity evaluation means 5 receives ejected droplets at an arbitrary moment, measures the mass of the droplets, and then generates a measurement signal on the basis of the measurement result and transmits the measurement signal to the feedback control means 8.

The feedback control means 8 compares the supplied signal with a predetermined reference signal for the mass of the droplet, and generates a control signal on the basis of the comparison result. Then, the feedback control means 8 supplies the control signal to the droplet ejecting means 2. The control signal is, for example, a command signal for requesting an increased amount of droplet, when a decreased amount of droplet is determined by the comparison of the measurement signal and the reference signal.

The droplet ejecting means 2 controls the amount of the droplet to be ejected on the basis of the control signal thus determined. For instance, it adjusts the amount of the droplets so as to increase the amount ejected by increasing the voltage.

As a result of these actions, variations in the amount ejected can be suppressed by correcting the amount of droplets, even if the amount of droplet changes due to a possible deviation in the establishment value in the droplet ejecting means 2 or a possible change in the characteristics of the droplets, for instance, the viscosity. The amount ejected can be more stably maintained with the same droplet ejecting means 2 by intentionally changing the composition of the droplet.

In the droplet ejecting apparatus 1, in order to perform the method for activating the droplet quantity evaluation means 5, more specifically in order to perform the method for measuring the mass of droplets during ejection of the droplets onto an article, either the droplet quantity evaluation means 5 is disposed on the flight trajectory of the droplets ejected from the droplet ejecting means 2, so that the droplet quantity evaluation means 5 temporarily receives the droplets, or the droplet ejecting means 2 is moved so as to temporarily receive the droplets by the droplet quantity evaluation means 5, or a combination of the two arrangements is employed.

In the above-mentioned droplet quantity evaluation means 5, the timing, the interval, and the period of evaluation can be optionally determined, but these are preferably preset.

The function of the droplet ejecting apparatus 1 when applied to an apparatus for uniformly mixing materials will be further described in detail below.

In the following, each of the above-mentioned means in the droplet ejecting apparatus 1 will be described.

As for the droplet ejecting means 2, any of the above-mentioned means can be employed so long as it can control the ejection on the basis of received electrical signals. In particular, the micropipette proposed in the above-mentioned specification is useful from the viewpoint of size and cost, and provides further advantages in usage, since it provides a reduced amount of supplied sample and substituted solution and since the ejection can be carried out at high speed.

Figure 2:
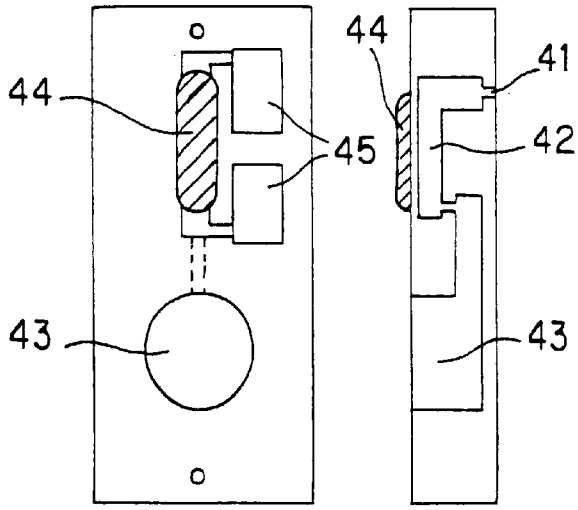
FIG. 2 shows a plan view and a sectional view of an embodiment of a micropipette as a droplet ejecting apparatus according to the invention.

The basic structure of the micropipette is constituted by a plurality of base elements made of a zirconia ceramic. As shown in FIG. 2, a base element includes a liquid supplying opening 43, a cavity 42 for storing the liquid, a droplet ejecting opening 41, and a piezoelectric element 44 mounted on the surface of the base element at least at the portion corresponding to the cavity 42, and is preferably constituted in such a manner that liquid flows in the cavity 42 in a laminar flow. The micropipette can eject a certain amount of the sample stored in the cavity 42 from the droplet ejecting opening 41 by changing the volume of the cavity 42 with the activation of the piezoelectric element 44, thereby enabling micro droplets to be produced accurately and with high efficiency at high speed.

The simplest structure of the feedback control means 8 comprises an input unit, an output unit, a signal conversion unit and a comparing/processing unit. As described above, by using these elements, a control signal is generated on the basis of the measurement signal from the droplet quantity evaluation means 5, and is then transferred to the droplet ejecting means 2. However, in order to perform a more accurate control and/or to supply information to the outside, the feedback control means 8 can be equipped with a memory unit for storing the supplied measurement signals, and it is preferable that a proportional control function, an integral control function, and a differential control function, all of which serve to more precisely process the control signal from the data of the measurement signal are installed in, e.g., the comparing/processing unit. It is further preferable that the functions of supplying warning information and/or data output are provided.

The respective units involved in the feedback control means 8 and the function thereof can be realized, for instance, by a computer program, which can be executed by a CPU and which is stored in a memory. In other words, they can be realized either by software or a hardware circuit, or by a combination of software and a hardware circuit.

As for the droplet quantity evaluation means 5, any of the means can be employed so long as it can measure the mass of the droplet and can supply the measured value as an electrical signal. For example, a mass sensor including electrodes mounted on both side surfaces of a quartz oscillator can be employed, wherein the mass of the material sticked on the surfaces can be estimated from a change in the resonance frequency for a shear oscillation in the direction within the plane of the electrodes, when a certain material is sticked onto the surface of the electrodes of the quartz oscillator.

In such a mass sensor, the sensing part on the electrodes is the same as the area, onto which a material to be measured is sticked. Accordingly, the quartz oscillator is subjected to a temperature variation resulting from the temperature of the sticked material. This provides a change in the piezoelectric properties and thus a shift of the resonance frequency, resulting in a reduction in accuracy in determining the mass of the droplets.

From this reason, it is desirable that the droplet quantity evaluation means has a resonance frequency sensing part which is different from that at the area at which the materials from the outside are affixed. As such an example, the droplet quantity evaluation means 5 can be employed, as described below.

Figure 3:
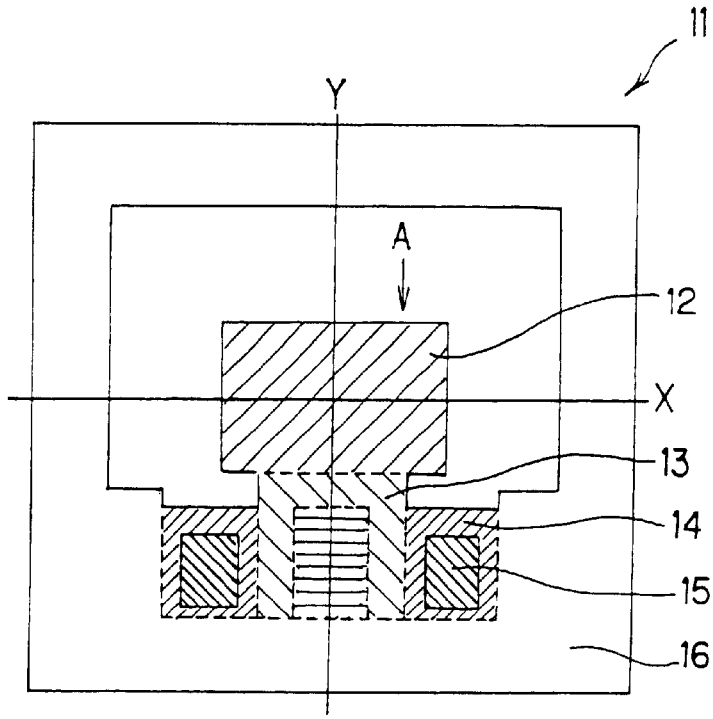
FIG. 3 shows a plan view of means for evaluating the quantity of the droplets in a droplet ejecting apparatus according to the invention.

FIG. 3 is a plan view of a resonating area in the droplet quantity evaluation means, which is used in the droplet ejecting apparatus according to the invention. The droplet quantity evaluation means 5 comprises a measuring member for determining the change in the resonance frequency resulting from receiving the droplets and thus for supplying the obtained result as an electrical signal and a processing member for evaluating a measurement signal from the electrical signal on the basis of a computer program, similarly to the feedback control means, and for supplying the measured signal as an electrical signal corresponding to the mass of the droplets. The measuring member further comprises a resonance member 11 for producing a change of the resonance frequency in response to the mass of the droplets received by the measuring element, and a frequency measuring member including measurement components, such as an impedance analyzer, a network analyzer, frequency counters or the like, for determining the resonance frequency. The resonance member 11 further comprises a substrate 16, a diaphragm 12 for receiving the ejected droplets, a sensing plate 14 including a piezoelectric element 15 for sensing the resonance frequency, and a connection plate 13 for connecting the diaphragm 12 to the substrate 16.

The function of the droplet quantity evaluation means having the above-mentioned structural arrangement is as follows.

When an electrical signal for measuring the frequency is applied to the piezoelectric element 15 from the measuring member, a mechanical oscillation is induced in the piezoelectric element 15 in response to the applied electrical signal, and then the oscillation propagates to the diaphragm 12 via the sensing plate 14 and the connection plate 13. When the frequency of the electrical signal becomes a certain value, the resonance occurs, so that the resonance member 11 oscillates at the resonance frequency. The frequency is determined by the electrical signal, which is feedback from the piezoelectric element 15 to the frequency measuring member. In the present invention, an oscillation mode (a form of oscillation) of the diaphragm 12 in the resonance can appropriately be selected in accordance with the aim of measurement and the object to be measured, as described below. The droplet quantity evaluation means 5 according to the structural arrangement has a greater degree of freedom in the design for setting a predetermined oscillation mode.

In the embodiment shown in FIG. 3, the diaphragm 12 is rectangular. However, a diaphragm having an arbitrary form, such as a circle, a polygon, or the like can be employed.

Moreover, the material for the diaphragm 12, connection plate 13, sensing plate 14, and substrate 16, which are all used in the resonance member 11, is no limited, but a ceramic, such as an alumina, a zirconia or the like, is preferable. For these plates, a composite unit which is formed by sintering these plates into an unified body is more preferable.

Since there is a certain relationship between the mass load subjected by the diaphragm 12 and the change in the resonance frequency of the oscillating member 11, the mass of the droplets can be determined from the measured value of the change in the resonance frequency with the aid of the droplet quantity evaluation means 5. In other words, the resonance frequencies of the resonance member 11 both in the state before the diaphragm 12 receives the droplets and at the state after the diaphragm 12 receives the droplets are measured with the aid of the frequency measuring member, and the mass of the ejected droplets can be determined from the change in the measured resonance frequency.

In the droplet quantity evaluation means 5, it is preferable that the measurable range of mass should be as wide as possible within a measurement accuracy where the mass of one droplet ejected can be measured. Under this condition, the mass of droplets is repeatedly measured, using the same droplet quantity evaluation means 5, so that a variation in the mass of each droplet can be determined. Of course, the measurement of the droplets can also be carried out in accordance with the type of application, and it is possible to measure the viscosity of droplets and a change in the specific gravity thereof, and to identify the intrusion of foreign materials and solid sticks on the surface of fluid channels in the droplet ejecting means 2 due to the drying and solidification of the material or a possible failure in ejection due to the blockage of the ejecting opening.

If the mass of one droplet ejected is sequentially measured, it is also possible to determine the time necessary for drying a droplet, the solid component in the droplet, the humidity, the concentration, etc.

In the droplet quantity evaluation means 5 where the mass of the droplet is determined from the relationship between a change in the mass of the diaphragm on which the droplets are ejected and a change in the resonance frequency of the oscillating member 11, it is preferable that the resonance frequency in the oscillation mode consisting mainly of the ν mode oscillation is sensed by the piezoelectric element 15, where a vertical axis (denoted by the Y axis) perpendicularly passing through the joined plane of the connection plate 13 and the substrate 16 being the center and the diaphragm 12 linearly reciprocates in the direction (the axis parallel to this direction is called by the X axis) parallel to the surface of the diaphragm 12 and perpendicular to the vertical axis.

Figure 4A:
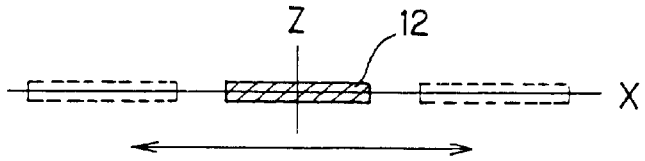
FIGS. 4(*a*) and 4(*b*) schematically show a droplet ejecting apparatus in a ν mode oscillation and a droplet ejecting apparatus in a rotation-around-axis mode oscillation according to the invention.
Figure 4B:
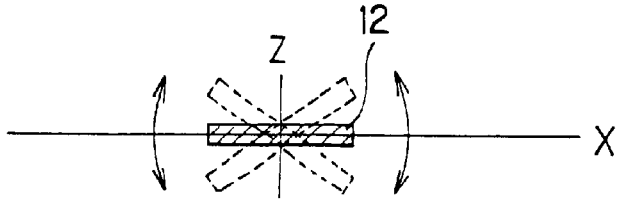

FIG. 4(*a*) is a drawing explaining the ν mode oscillation, and represents the movement of the diaphragm 12, viewing the oscillating member 11 in the droplet quantity evaluation means 5, as shown in FIG. 3, in the direction of the Y axis on the X axis. In this case, the upper part of the side surface of the diaphragm 12 keeps still in the state of non-oscillation, whereas in the ν mode oscillation the diaphragm 12 oscillates in the direction of X axis in a plane containing the plane of the diaphragm 12, and has little component of oscillation in the direction of Y axis. Hence, the movement of the upper part of the side surface of the diaphragm 12 can be represented as a oscillation in which the diaphragm 12 reciprocatedly moves along the X axis. This movement of oscillation is referred to as the ν mode oscillation.

In order to obtain the oscillation mode consisting mainly of the ν mode oscillation, it is preferable that the size of the diaphragm 12 satisfies the following relation, $$0.7<a/b<5, \quad (1)$$

where the maximum size in the direction of the Y axis is b, and the maximum size in the direction of the X axis is a. More preferably, the size ratio should be $0.9<a/b<2.5$.

In the oscillation mode consisting mainly of the ν mode oscillation, the difference in the sensitivity in the plane of the diaphragm 12, i.e., the positional difference in the change of the frequency for a mass, is small, so that even if the droplet is ejected at any position in the diaphragm 12, the measurement can be carried out at approximately the same accuracy, and therefore no accurate positioning of the diaphragm 12 is needed, hence making it possible to measure the mass of droplets at high accuracy. In this case, the oscillation mode consisting mainly of the ν mode oscillation is referred to as the oscillation mode containing the oscillation mode of the ν mode oscillation, at which at least the maximum amplitude in the direction of the X axis is greater than the maximum amplitude in the direction of the Y axis.

In the oscillation mode consisting mainly of the ν mode oscillation, moreover, the positional difference in the sensitivity is particularly smaller in the direction of the X axis than in the direction of the Y axis, and therefore, it is preferable that the droplet quantity evaluation means 5 and/or the droplet ejecting means 2 is moved in the main oscillation direction, i.e., in the direction parallel to the X axis, when the diaphragm is moved in order to optimally receive the droplets.

For the thickness t (cm) of the diaphragm, the density $d_c$ (g/cm$^3$) of the diaphragm, the volume V (cm$^3$) of a droplet, and the density $d_r$ (g/cm$^3$) of the droplet, it is preferable that the area S (cm$^2$) of the diaphragm satisfies the following relation:

$$2.5\times10^{-5}+(1.5\times V)^{2/3}\times\pi^{1/3}<S<V\times d_r\times10^6/(t\times d_c) \quad (2).$$

This is because the area of the diaphragm 2 is large enough to receive the ejected droplets, while maintaining a linear sensitivity of the diaphragm 12, i.e., a linear relationship between the mass of the droplet and the change in the resonance frequency in the oscillation mode consisting mainly of the ν mode oscillation.

Moreover, it is particularly desirable if the equations (1) and (2) are simultaneously satisfied, since the oscillation mode consisting mainly of the ν mode oscillation can be efficiently obtained and a linear sensitivity can also be obtained for the droplet quantity evaluation means.

As described above, the droplet quantity evaluation means in the oscillation mode consisting mainly of the ν mode oscillation provides a stable ejection of each single droplet, thereby enabling the amount of ejected droplets to be more accurately controlled. In conjunction with such a control of the amount of ejected droplets, the usage of the droplet quantity evaluation means in a rotation-around-axis mode or a rotation-in-plane mode, as described below, makes it possible to further control the arrival position of droplets.

The oscillation in the rotation-around-axis mode, which is shown in FIG. 4(*b*), is referred to as a oscillation mode in which the diaphragm 12 moves in a reciprocating rotation around a vertical axis (Y axis) perpendicularly passing through the joined surface of the connection plate 13 and the substrate 16, and in which at least the phases of the displacements in the X axis direction at both ends in the plane of the diaphragm 12 are opposite to each other (i.e., the displacements in the Z axis direction being opposite to each other). The resonance frequency of said oscillation is sensed by the piezoelectric element 15.

If the rotation-around-axis mode oscillation is used, a difference occurs in the sensitivity of detection in the X axis direction and that in the plane of the diaphragm 12 of the droplet quantity evaluation means 5 in accordance with the distance from the center axis of rotation in the X axis direction, so that using the difference in the sensitivity of detection, the single axis control of position in the X axis direction can be carried out.

Figure 5:
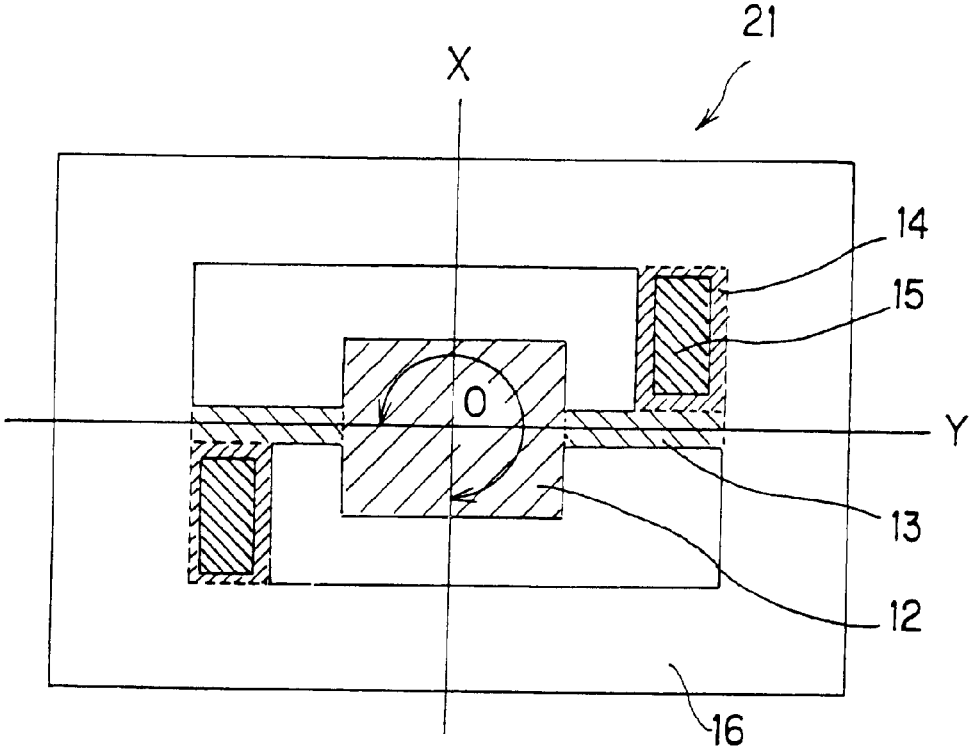
FIG. 5 shows a plan view of a droplet ejecting apparatus according to the invention for explaining the oscillation in a rotation-in-plane mode.

The rotation-in-plane mode oscillation shown in FIG. 5 is referred to as a oscillation mode in which the diaphragm 12 moves in a reciprocating rotation in the plane of the diaphragm 12, and in which the center of rotation is situated at least in the plane of the diaphragm 12. The resonance frequency of this oscillation is sensed by the piezoelectric element 15.

The usage of the rotation-in-plane mode oscillation provides a difference in the sensitivity of detection in accordance with the distance from the center of rotation C situated in the plane of the diaphragm 12, as exemplified in FIG. 5, so that using the difference in the sensitivity of detection, a dual axis position control in the X and Y axes can be carried out.

Since the position of ejected droplets can be determined using one of these rotation mode oscillations, as described above, the arrival position of the ejected droplets can be set to be located at the center of rotation in the plane of the diaphragm 12 by feeding back the obtained information to the droplet ejecting means 2 and by controlling the direction of ejection. The usage of a droplet ejecting apparatus 1 including a plurality of droplet ejecting means 2 makes it possible to adjust the arrival positions of all droplet ejecting means 2, so that, for instance, in an application where the materials are uniformly mixed by colliding the ejected droplets, the droplets ejected from these droplet ejecting means collide with each other more accurately and more securely, thereby enabling the quality, e.g., the homogeneity of the composition of a mixture, to be enhanced.

In the diaphragm 12 according to the invention, droplets are received by one surface thereof. However, both surfaces may receive droplets. In this case, the measurement area is increased and therefore the measurement range in the droplet quantity evaluation means can be expanded. Moreover, there is an advantage in that one droplet quantity evaluation means can be used for a plurality of droplet ejecting apparatuses. For instance, two droplet ejecting means facing each other via a very small spacing are used, and therefore it is difficult to receive the droplets on one surface of the diaphragm 12. Even in such a case, measurement with both surfaces is possible. This suggests that the droplet ejecting apparatus according to the invention can be employed in various applications.

EXAMPLES

In the following, the droplet ejecting apparatus according to the invention will be described, referring to FIG. 6. However, the present invention is not restricted to this embodiment.

Figure 6:
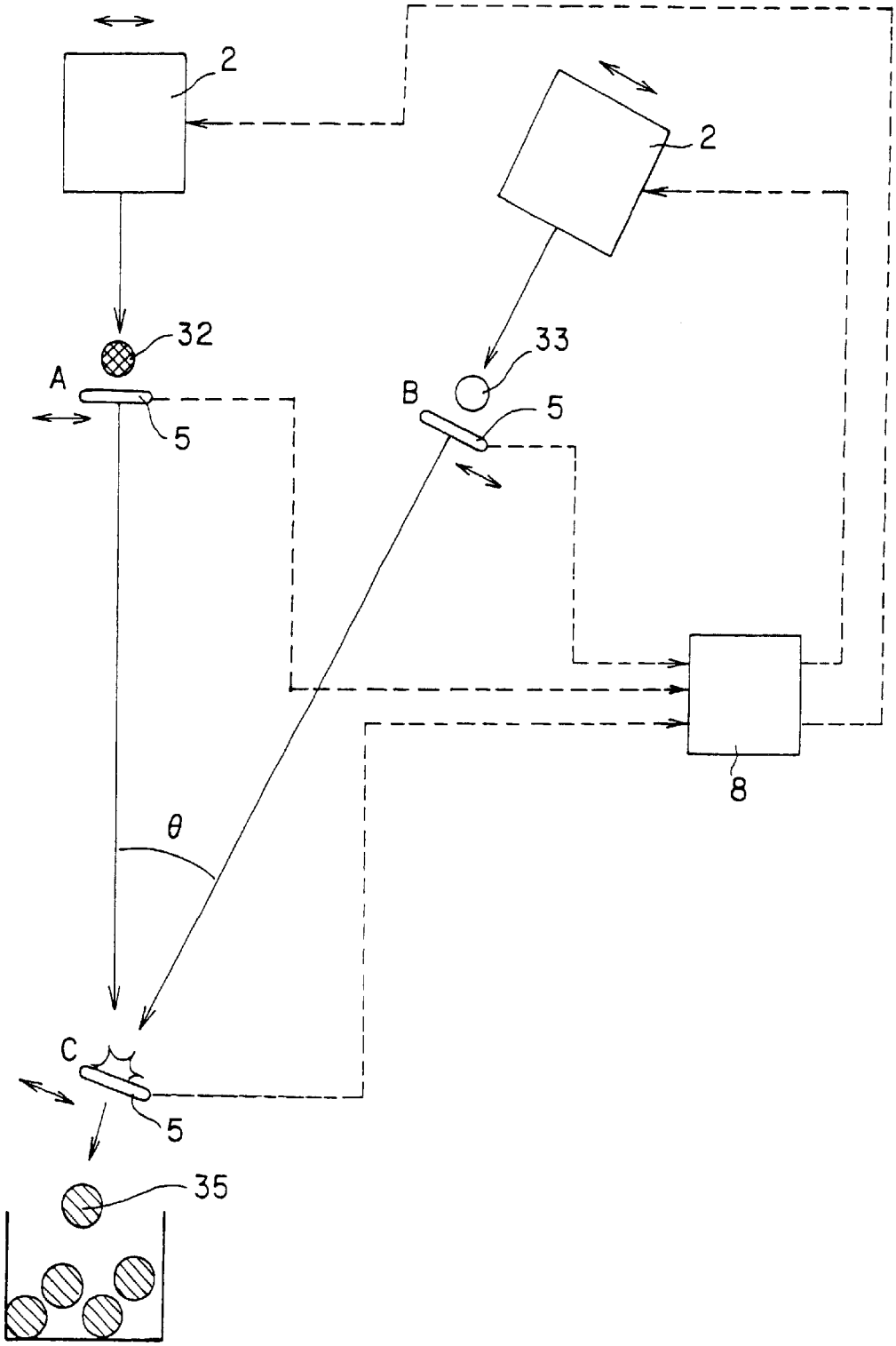
FIG. 6 is a block diagram of a system for uniformly mixing materials in which two droplet ejecting apparatuses according to the invention are employed.

FIG. 6 shows an embodiment of the droplet ejecting apparatus according to the invention, which is employed in the above-mentioned apparatus for uniformly mixing materials. In FIG. 6, two droplet ejecting means 2 are employed, and the ejection directions in both droplet ejecting means 2 are set so as to provide a collision angle θ for micro droplets.

Droplets 32 and 33, which react with each other when they are mixed, are ejected as micro droplets from two droplet ejecting means 2, and collide with each other in midair. A uniform mixture 35 of the droplets, which is produced by collision, flies in a specific direction determined by the inertial force of the collided droplets 32 and 33, and is then collected in a collection vessel.

In such an apparatus for uniformly mixing the materials, two droplet quantity evaluation means 5 are disposed in the respective flight trajectories of the droplets in order to evaluate the quantity of flying droplets 32 and 33.

Example 1

Two droplet quantity evaluation means 5 for use of mass measurement in the oscillation mode consisting mainly of the ν mode oscillation (hereafter this measurement is referred to as the ν mode) are respectively at points A and B on the flight trajectories of droplets ejected from the droplet ejecting means 2. The droplet ejecting means 2 and the droplet quantity evaluation means 5 in the ν mode can move respectively in directions indicated by the corresponding arrow, as shown in FIG. 6, where the directions are limited to the main oscillation directions in the corresponding diaphragms, and the droplet quantity evaluation means 5 in the ν mode receive droplets ejected from the droplet ejecting means 2. The droplet quantity evaluation means 5 in the ν mode measure the mass of the droplets and then transfer the obtained results to a feedback control means 8. On the basis of the measurement results, the feedback control means 8 generates corresponding control signals and supplies them to respective droplet ejecting means 2, thereby enabling the amounts of droplets to be adjusted respectively in the desired values.

Point C is the position of collision, i.e., the position at which the droplets 32 and 33 arrive. One droplet quantity evaluation means 5 for two axes position control in the rotation-in-plane mode (hereafter, this control is referred to as the rotation-in-plane mode) is disposed at point C. The droplet quantity evaluation means 5 in the rotation-in-plane mode can be moved in an arbitrary direction, thereby enabling positional control to be achieved. These droplet ejecting means 2 eject several times the respective droplets to the droplet quantity evaluation means 5 in the rotation-in-plane mode from arbitrary different positions, in which case the droplets are adjusted respectively in a specified mass by said droplet quantity evaluation means 5 in the ν mode. The droplet quantity evaluation means 5 in the rotation-in-plane mode, which receives the droplets, exhibits a difference in sensitivity in proportion to the distance from the center of rotation in the diaphragm, and thus provides a change in the resonance frequency in accordance with the arrival position of the droplet. The result of the measurement is transferred from the droplet quantity evaluation means 5 in the rotation-in-plane mode to the feedback control means 8. Since a greater amount of change in the frequency arises as the droplet is received at a greater distance from the center of rotation, the direction of ejection is adjusted so as to reduce the change in the frequency, that is, the control is made in such a manner that the arrival position of the droplet approaches the center of rotation in the diaphragm. By applying this control method to all the droplet ejecting means 2, the arrival positions of droplets ejected by the respective droplet ejecting means 2 can be accurately adjusted. In this case, the ejection timing is shifted for each of the droplets 32 and 33 ejected from the droplet ejecting means 2, and the arrival positions of each droplet are individually controlled. Thus, the amount of the ejected droplet and the arrival position thereof can be accurately adjusted. After completing the above adjustments, a desired mixture is produced by actually colliding the droplets with each other.

Example 2

One droplet quantity evaluation means 5 in the ν mode and one droplet quantity evaluation means 5 in the rotation-in-plane mode are disposed at point C on the flight trajectories of droplets ejected from two droplet ejecting means 2, at which point the droplets collide with each other.

In this case, the ejection timing is shifted for each of the droplets 32 and 33 ejected from the respective droplet ejecting means 2 to two droplet quantity evaluation means, and the control is carried out by feeding back the amount of a droplet and the arrival position thereof to the respective droplet ejecting means 2. As a result, the amount of the ejected droplets and the arrival position thereof can be accurately controlled. After completing the above controls, a desired mixture is obtained by actually colliding the droplets with each other As described above, the provision of the droplet ejecting apparatus according to the invention in an apparatus for uniformly mixing materials ensures secure collision of the droplets with each other without any need to collect non-collided droplets, so that the process of uniformly mixing very small amounts of materials can be carried out with high efficiency.

In the above description, the present invention is described with reference to the preferred embodiments. However, the present invention is not limited to the embodiments disclosed herein. Various modifications, revisions and alterations are possible within the scope of the appended claims for a person skilled in the art.

What is claimed is:

1. A droplet ejecting apparatus for ejecting micro droplets, comprising:

at least one droplet quantity evaluation means, wherein the mass of a droplet ejected onto an article is measured, and a measurement signal is generated based on the measurement result;

feedback control means, wherein said measurement signal is compared with a respective reference value and then a control signal is generated based on the result of comparison; and at least one droplet ejecting means for adjusting the amount of ejection for the droplet on the basis of said control signal.

2. A droplet ejecting apparatus according to claim 1, wherein said droplet ejecting means comprises a micropipette including a cavity for storing a liquid, and a piezoelectric element for changing the volume of said cavity.

3. A droplet ejecting apparatus according to claim 2, wherein said droplet quantity evaluation means comprises a measuring member for measuring the change in resonance frequency as a result of receiving the droplet and for supplying the measurement result as an electrical signal, a processing member for determining the mass of the droplet by executing a predetermined calculation on the basis of said supplied electrical signal and for supplying said measurement signal, wherein said measuring member comprises at least a resonance member for providing a change in the resonance frequency in response to the mass of the droplet received by said measuring member, and a frequency measuring member for measuring the change in the resonance frequency, and wherein said resonance member comprises a substrate, a diaphragm for receiving the ejected droplet, a sensing plate including the piezoelectric element for sensing the resonance frequency in said resonance member and a connecting plate for connecting said diaphragm and said substrate.

4. A droplet ejecting apparatus according to claim 3, wherein the mass of the ejected droplet received by one surface or both surfaces of said diaphragm is measured.

5. A droplet ejecting apparatus according to claim 3, wherein said droplet quantity evaluation means and/or said droplet ejecting means is moved in such a manner that said droplet quantity evaluation means can receive the droplets, and then the mass of said droplet is measured.

6. A droplet ejecting apparatus according to claim 3, wherein said droplet quantity evaluation means measures the resonance frequencies in said resonance member before and after the droplet is received, and determines the mass of said droplet ejected from said droplet ejecting means on the basis of the measured change in the resonance frequency.

7. A droplet ejecting apparatus according to claim 3, wherein said resonance frequency is the same as a resonance frequency in the oscillation mode consisting mainly of the ν mode oscillation, where the vertical axis perpendicularly passing through a joined plane of said connection plate and said substrate being the center and said diaphragm linearly reciprocates in the direction parallel to the surface of said diaphragm and perpendicular to said vertical axis.

8. A droplet ejecting apparatus according to claim 6, wherein said resonance frequency is the same as a resonance frequency in the oscillation mode consisting mainly of the ν mode oscillation, where the vertical axis perpendicularly passing through a joined plane of said connection plate and said substrate being the center and said diaphragm linearly reciprocates in the direction parallel to the surface of said diaphragm and perpendicular to said vertical axis.

9. A droplet ejecting apparatus according to claim 7, wherein for the maximum size b of said diaphragm in the direction of the vertical axis perpendicularly passing through the joined plane of said connection plate and said substrate and for the maximum size a of said diaphragm in the direction parallel to the surface and perpendicular to said vertical axis, the ratio of the sizes satisfies the following relation:

$$0.7<a/b<5.$$

10. A droplet ejecting apparatus according to claim 8, wherein for the maximum size b of said diaphragm in the direction of the vertical axis perpendicularly passing through the joined plane of said connection plate and said substrate and for the maximum size a of said diaphragm in the direction parallel to the surface and perpendicular to said vertical axis, the ratio of the sizes satisfies the following relation:

$$0.7<a/b<5.$$

11. A droplet ejecting apparatus according to claim 7, wherein for the thickness t (cm) of the diaphragm, the density $d_c$ (g/cm$^3$) of the diaphragm, the volume V (cm$^3$) of a droplet and the density $d_r$ (g/cm$^3$) of the droplet, and the area S (cm$^2$) of the diaphragm are set within a range at which the following relation is satisfied:

$$2.5\times10^{-5}+(1.5\times V)^{2/3}\times\pi^{1/3}<S<V\times d_r\times10^6/(t\times d_c).$$

12. A droplet ejecting apparatus according to claim 8, wherein for the thickness t (cm) of the diaphragm, the density $d_c$ (g/cm$^3$) of the diaphragm, the volume V (cm$^3$) of a droplet and the density $d_r$ (g/cm$^3$) of the droplet, and the area S (cm$^2$) of the diaphragm are set within a range at which the following relation is satisfied:

$$2.5\times10^{-5}+(1.5\times V)^{2/3}\times\pi^{1/3}<S<V\times d_r\times10^6/(t\times d_c).$$

13. A droplet ejecting apparatus according to claim 9, wherein for the thickness t (cm) of the diaphragm, the density $d_c$ (g/cm$^3$) of the diaphragm, the volume V (cm$^3$) of a droplet and the density $d_r$ (g/cm$^3$) of the droplet, and the area S (cm$^2$) of the diaphragm are set within a range at which the following relation is satisfied:

$$2.5\times10^{-5}+(1.5\times V)^{2/3}\times\pi^{1/3}<S<V\times d_r\times10^6/(t\times d_c).$$

14. A droplet ejecting apparatus according to claim 10, wherein for the thickness t (cm) of the diaphragm, the density $d_c$ (g/cm$^3$) of the diaphragm, the volume V (cm$^3$) of a droplet and the density $d_r$ (g/cm$^3$) of the droplet, and the area S (cm$^2$) of the diaphragm are set within a range at which the following relation is satisfied:

$$2.5\times10^{-5}+(1.5\times V)^{2/3}\times\pi^{1/3}<S<V\times d_r\times10^6/(t\times d_c).$$

15. A droplet ejecting apparatus according to claim 11, wherein said droplet quantity evaluation means and/or said droplet ejecting means is moved in such a manner that said droplet quantity evaluation means receives the droplet in the main oscillation direction of said diaphragm.

16. A droplet ejecting apparatus according to claim 12, wherein said droplet quantity evaluation means and/or said droplet ejecting means is moved in such a manner that said droplet quantity evaluation means receives the droplet in the main oscillation direction of said diaphragm.

17. A droplet ejecting apparatus according to claim 13, wherein said droplet quantity evaluation means and/or said droplet ejecting means is moved in such a manner that said droplet quantity evaluation means receives the droplet in the main oscillation direction of said diaphragm.

18. A droplet ejecting apparatus according to claim 14, wherein said droplet quantity evaluation means and/or said droplet ejecting means is moved in such a manner that said droplet quantity evaluation means receives the droplet in the main oscillation direction of said diaphragm.

19. A droplet ejecting apparatus according to claim 3, wherein said resonance frequency is the same as a resonance frequency in the oscillation mode of the rotation-around-axis oscillation where said diaphragm reciprocates in a rotary oscillation around a vertical axis perpendicularly passing through the joined plane of said connection plate and said substrate.

20. A droplet ejecting apparatus according to claim 6, wherein said resonance frequency is the same as a resonance frequency in the oscillation mode of the rotation-around-axis oscillation where said diaphragm reciprocates in a rotary oscillation around a vertical axis perpendicularly passing through the joined plane of said connection plate and said substrate.

21. A droplet ejecting apparatus according to claim 3, wherein said resonance frequency is the same as a resonance frequency in the oscillation mode of the rotation-in-plane oscillation where said diaphragm reciprocates in a rotary oscillation in a plane containing said diaphragm in such a manner that the center of rotation is situated at least within said diaphragm.

22. A droplet ejecting apparatus according to claim 6, wherein said resonance frequency is the same as a resonance frequency in the oscillation mode of the rotation-in-plane oscillation where said diaphragm reciprocates in a rotary oscillation in a plane containing said diaphragm in such a manner that the center of rotation is situated at least within said diaphragm.

23. A droplet ejecting apparatus according to claim 19, wherein the direction of ejection in said droplet ejecting means is controlled on the basis of the difference in the sensitivity in the plane of the diaphragm in accordance with the distance from the center of rotation in said diaphragm.

24. A droplet ejecting apparatus according to claim 20, wherein the direction of ejection in said droplet ejecting means is controlled on the basis of the difference in the sensitivity in the plane of the diaphragm in accordance with the distance from the center of rotation in said diaphragm.

25. A droplet ejecting apparatus according to claim 21, wherein the direction of ejection in said droplet ejecting means is controlled on the basis of the difference in the sensitivity in the plane of the diaphragm in accordance with the distance from the center of rotation in said diaphragm.

26. A droplet ejecting apparatus according to claim 22, wherein the direction of ejection in said droplet ejecting means is controlled on the basis of the difference in the sensitivity in the plane of the diaphragm in accordance with the distance from the center of rotation in said diaphragm.

27. A droplet ejecting apparatus according to claim 2, wherein said droplet quantity evaluation means has a measurable range of mass greater than the mass of a droplet ejected, and wherein the mass of droplets can be determined by repeatedly measuring the mass of each droplet with the same droplet quantity evaluation means.

28. A droplet ejecting apparatus according to claim 2, wherein said droplet quantity evaluation means can be promptly operated at an arbitrary moment when said droplet ejecting apparatus is operated.

* * * * *